US008718530B2

(12) United States Patent
Kudo et al.

(10) Patent No.: US 8,718,530 B2
(45) Date of Patent: May 6, 2014

(54) LUBRICANT SUPPLY DEVICE, PROCESS CARTRIDGE, AND IMAGE FORMING APPARATUS

(75) Inventors: Norio Kudo, Kanagawa (JP); Shinichi Kawahara, Tokyo (JP); Nobuo Kuwabara, Kanagawa (JP); Takeshi Shintani, Kanagawa (JP); Akio Kosuge, Kanagawa (JP); Daisuke Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 149 days.

(21) Appl. No.: 13/483,698

(22) Filed: May 30, 2012

(65) Prior Publication Data

US 2012/0315053 A1 Dec. 13, 2012

(30) Foreign Application Priority Data

Jun. 11, 2011 (JP) ..... 2011-130749
Jun. 14, 2011 (JP) ..... 2011-132099
Nov. 10, 2011 (JP) ..... 2011-246298

(51) Int. Cl.
*G03G 21/00* (2006.01)
*G03G 15/00* (2006.01)

(52) U.S. Cl.
USPC ..... 399/346; 399/44

(58) Field of Classification Search
CPC ... G03G 15/50; G03G 21/0094; G03G 21/20; G03G 2221/0026
USPC ..... 399/44, 346, 71
See application file for complete search history.

(56) References Cited

U.S. PATENT DOCUMENTS

| | | | | |
|---|---|---|---|---|
| 6,640,080 | B2 * | 10/2003 | Endo et al. | 399/71 |
| 8,041,280 | B2 | 10/2011 | Koike et al. | |
| 8,406,677 | B2 * | 3/2013 | Kondo | 399/346 |
| 2005/0244176 | A1 * | 11/2005 | Nakai et al. | 399/44 |
| 2009/0241830 | A1 | 10/2009 | Koike et al. | |
| 2010/0183349 | A1 | 7/2010 | Shintani et al. | |
| 2011/0026992 | A1 | 2/2011 | Shintani et al. | |
| 2012/0134725 | A1 | 5/2012 | Kawahara et al. | |
| 2012/0321330 | A1 * | 12/2012 | Kudo et al. | 399/44 |

FOREIGN PATENT DOCUMENTS

| | | | |
|---|---|---|---|
| JP | 07-271142 | A | 10/1995 |
| JP | 09-062163 | A | 3/1997 |
| JP | 2001305907 | A | 11/2001 |
| JP | 2002-244487 | A | 8/2002 |
| JP | 2002-341694 | A | 11/2002 |

* cited by examiner

*Primary Examiner* — Susan Lee
(74) *Attorney, Agent, or Firm* — Harness, Dickey & Pierce, P.L.C.

(57) ABSTRACT

A lubricant supply device including a solid lubricant, a lubricant supply roller, a detector, and a varying device is provided. The lubricant supply roller is adapted to supply the lubricant to a toner image bearing member and is rotatable in a predetermined direction while slidably contacting both the solid lubricant and the toner image bearing member. The detector is adapted to detect an absolute humidity around the lubricant supply device. The varying device is adapted to vary an amount of the lubricant to be supplied to the toner image bearing member based on the absolute humidity detected by the detector.

13 Claims, 8 Drawing Sheets

| ABSOLUTE HUMIDITY | LOW | MIDDLE | HIGH |
|---|---|---|---|
| REVOLUTION OF LUBRICANT SUPPLY ROLLER | 0.8 × α | α | 1.2 × α |

FIG. 9
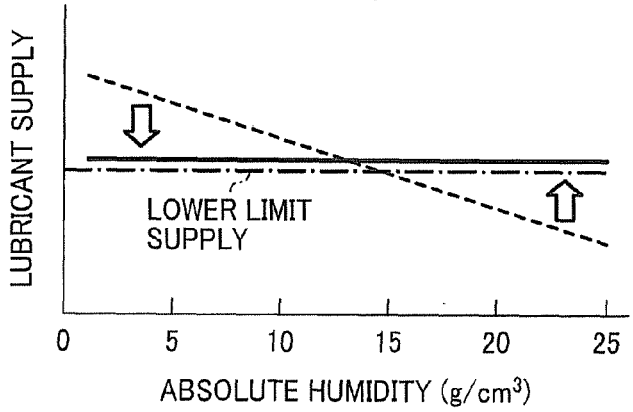
FIG. 10
| ABSOLUTE HUMIDITY | LOW | MIDDLE | HIGH |
|---|---|---|---|
| REVOLUTION OF LUBRICANT SUPPLY ROLLER | $\alpha$ | $\alpha$ | $1.2 \times \alpha$ |
FIG. 11
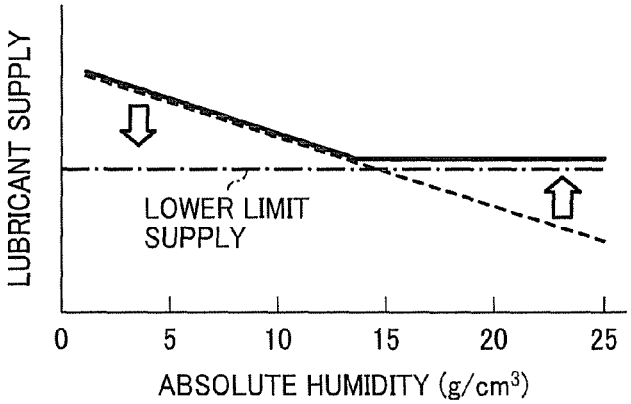

LUBRICANT SUPPLY DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2011-130749, 2011-132099, and 2011-246298, filed on Jun. 11, 2011, Jun. 14, 2011, and Nov. 10, 2011, respectively, in the Japanese Patent Office, the entire disclosure of each if which is hereby incorporated herein by reference.

BACKGROUND

1. Technical Field

The present disclosure relates to a lubricant supply device, a process cartridge, and an image forming apparatus.

2. Description of Related Art

An image forming apparatus, such as copier and printer, employing a lubricant supply device is known. The lubricant supply device is adapted to supply lubricant to an image bearing member such as photoreceptor drum or intermediate transfer belt.

In such an image forming apparatus, a toner image is formed on a photoreceptor drum and then transferred onto a transfer medium. Residual toner particles remaining on the photoreceptor drum without being transferred onto the transfer medium are generally removed by a cleaning blade disposed in contact with the photoreceptor drum. In cases where the cleaning blade gets chipped due to friction with the photoreceptor drum, residual toner particles may pass through a gap formed between the chipped cleaning blade and the photoreceptor drum and may fixedly accumulate on the photoreceptor drum, which is undesirable.

One attempt to solve this problem involves applying a lubricant to the photoreceptor drum to reduce friction coefficient thereof, so that the cleaning blade is prevented from being abraded or chipped as well as the photoreceptor drum is prevented from deteriorating.

Japanese Patent Application Publication No. 2001-305907 discloses a lubricant supply device including a brush-like roller (i.e., lubricant supply roller) slidably contactable with a photoreceptor belt (i.e., image bearing member), a solid lubricant in contact with the brush-like roller, a compressed spring for biasing the solid lubricant against the brush-like roller. The brush-like roller scrapes the solid lubricant off by rotating in a predetermined direction and applies (supplies) it to the surface of the image bearing member.

Japanese Patent Application Publication No. 07-271142 discloses a lubricant supply device in which the amount of lubricant to be supplied from a lubricant supply roller to an intermediate transfer belt (i.e., image bearing member) is increased by increasing the revolution of the lubricant supply roller when the environmental temperature and humidity are beyond predetermined ranges.

Japanese Patent Application Publication No. 09-62163 discloses a lubricant supply device having a temperature sensor for detecting the surface temperature of a photoreceptor drum (i.e., image bearing member). Operation of the lubricant supply device is controlled based on a result detected by the temperature sensor.

SUMMARY

In accordance with some embodiments, a lubricant supply device including a solid lubricant, a lubricant supply roller, a detector, and a varying device is provided. The lubricant supply roller is adapted to supply the lubricant to a toner image bearing member and is rotatable in a predetermined direction while slidably contacting both the solid lubricant and the toner image bearing member. The detector is adapted to detect an absolute humidity around the lubricant supply device. The varying device is adapted to vary an amount of the lubricant to be supplied to the toner image bearing member based on the absolute humidity detected by the detector.

In accordance with some embodiments, an image forming apparatus including a toner image bearing member, a lubricant supply device, a charger, an irradiator, a developing device, and a transfer device is provided. The lubricant supply device includes a solid lubricant, a lubricant supply roller, a first detector, and a varying device. The lubricant supply roller is adapted to supply the lubricant to the toner image bearing member and is rotatable in a predetermined direction while slidably contacting both the solid lubricant and the toner image bearing member. The first detector is adapted to detect an absolute humidity around the image forming apparatus and is disposed apart from the toner image bearing member. The varying device is adapted to vary an amount of the lubricant to be supplied to the toner image beating member based on the absolute humidity detected by the first detector. The charger is adapted to charge the toner image bearing member. The irradiator is adapted to irradiate the charged toner image bearing member with light to form an electrostatic latent image thereon. The developing device is adapted to develop the electrostatic latent image into a toner image. The transfer device is adapted to transfer the toner image from the toner image bearing member onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 9 is a graph showing a relation between absolute humidity and lubricant supply in the lubricant supply device under control of the revolution of the lubricant supply roller in the lubricant supply device according to the controlling conditions described in FIG. 6;

FIG. 10 is a table showing other controlling conditions of the revolution of the lubricant supply roller in the lubricant supply device accompanied by absolute humidity change; and FIG. 11 is a graph showing a relation between absolute humidity and lubricant supply in the lubricant supply device under control of the revolution of the lubricant supply roller in the lubricant supply device according to the controlling conditions described in FIG. 10.

DETAILED DESCRIPTION

Figure 1:
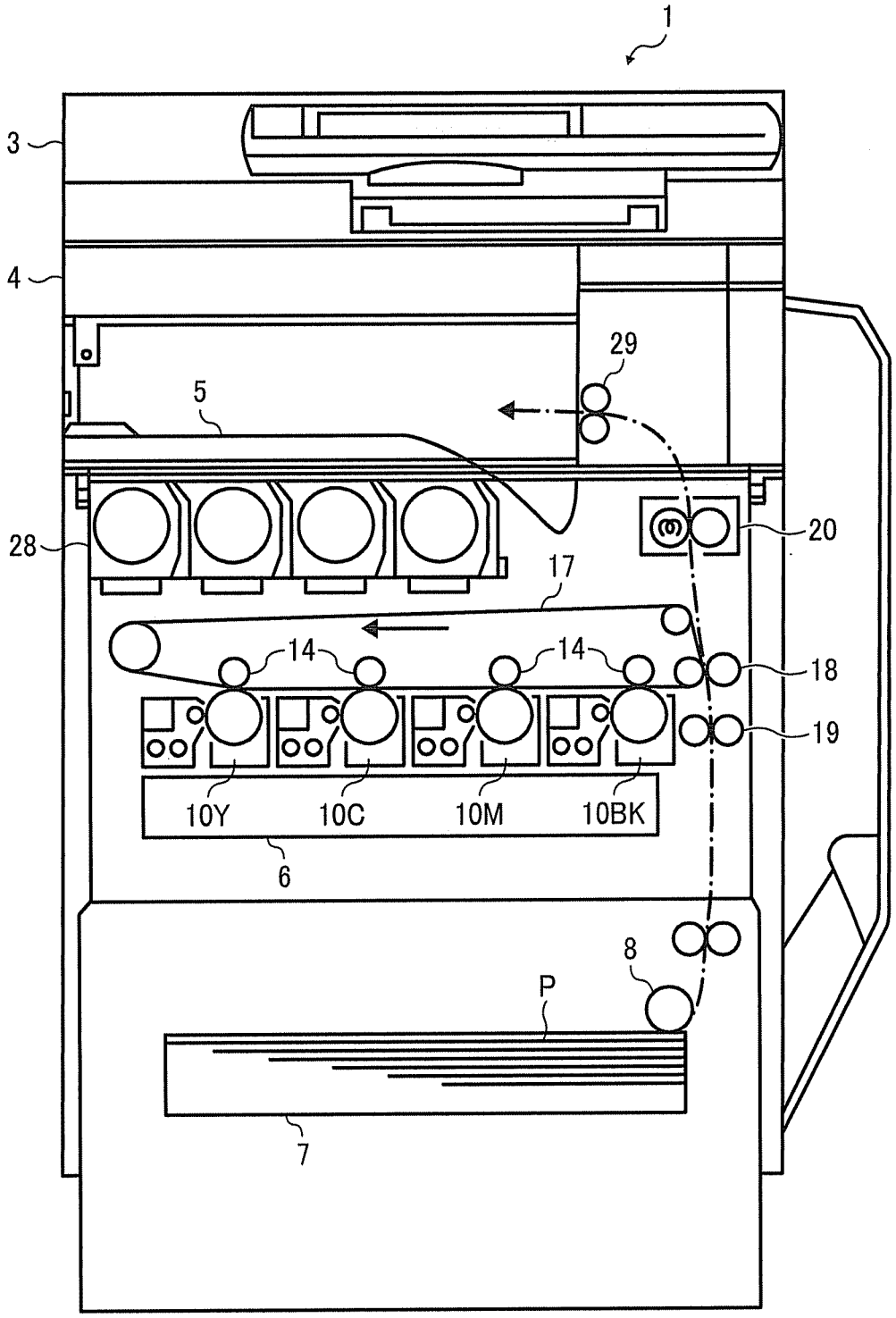
FIG. 1 is a schematic view of an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment. An image forming apparatus 1 is a tandem-type full-color image forming apparatus in which multiple process cartridges are disposed in tandem facing an intermediate transfer belt.

The image forming apparatus 1 includes a document feeder 3, a document reader 4, a writing device 6, a paper feeder 7, process cartridges 10Y, 10C, 10M, and 10BK, an intermediate transfer belt 17, a secondary transfer roller 18, a fixing device 20, and toner containers 28. The document feeder 3 is adapted to feed a document to the document reader 4. The document reader 4 is adapted to read image information of the document. The writing device 6 is adapted to emit laser light based on the image information. The paper feeder 7 is adapted to store and feed a recording medium P. The process cartridges 10Y, 10C, 10M, and 10BK are each adapted to form toner images of yellow, cyan, magenta, and black, respectively. The toner images are sequentially transferred onto the intermediate transfer belt 17 to form a composite toner image thereon. The secondary transfer roller 18 is adapted to transfer the composite toner image from the intermediate transfer belt 17 onto the recording medium P. The fixing device 20 is adapted to fix the composite toner image on the recording medium P. Each toner container 28 is adapted to store and supply toner to each process cartridges 10Y, 10C, 10M, and 10BK.

Figure 2:
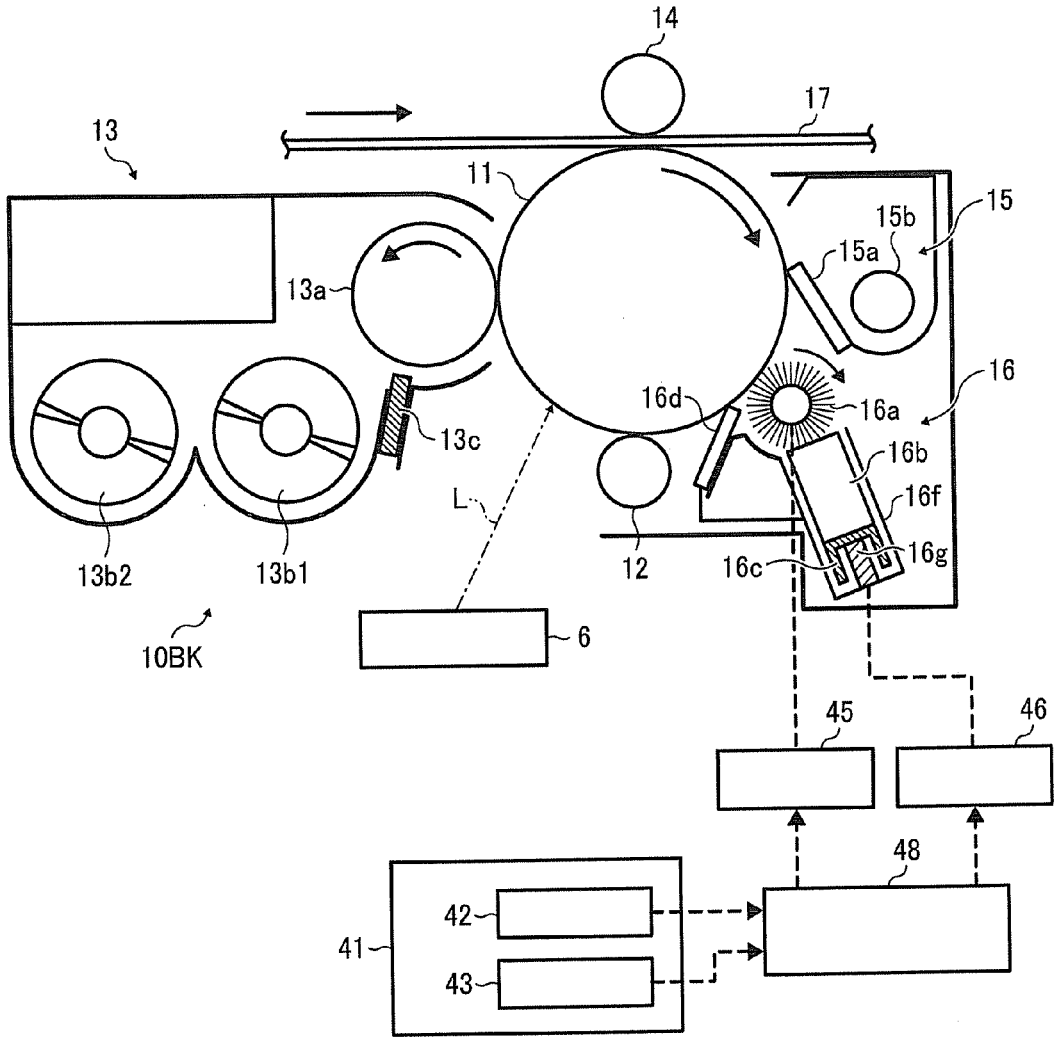
FIG. 2 is a magnified view of a process cartridge included in the image forming apparatus illustrated in FIG. 1.

Each process cartridge 10Y, 10C, 10M, or 10BK integrally supports a photoreceptor drum 11 serving as an image bearing member, a charger 12, a developing device 13, a cleaning device 15, and a lubricant supply device 16, as depicted in FIG. 2. The process cartridges 10Y, 10C, 10M, and 10BK are independently replaceable upon reaching the end of their usefulness. Toner images of yellow, cyan, magenta, and black are each formed on the photoreceptor drum 11 in the respective process cartridges 10Y, 10C, 10M, and 10BK.

An image forming operation is described in detail below. First, a feed roller of the document feeder 3 feeds a document onto a contact glass of the document reader 4. The document reader 4 optically reads image information of the document on the contact glass.

More specifically, the document reader 4 scans the document with light emitted from a lamp. The light is reflected by the document and is passed through a group of mirrors and a lens to form an image in a color sensor. The color sensor reads RGB image information based on color separation lights of red, green, and blue. The RGB image information is then converted into an electric image signal. An image processor processes color conversion, color correction, and spatial frequency correction based on the image signal to obtain image information of yellow, cyan, magenta, and black.

The image information of yellow, cyan, magenta, and black is transmitted to the writing device 6. The writing device 6 emits light toward the photoreceptor drum 11 in each process cartridge 10Y, 10C, 10M, and 10BK based on the image information.

Each photoreceptor drum 11 rotates clockwise in FIG. 1. A surface of the photoreceptor drum 11 is uniformly charged by the charger 12 at a position where the photoreceptor drum 11 faces the charger 12, thus forming a charged potential on the photoreceptor drum 11. The charged surface, of the photoreceptor drum 11 then reaches a position where the photoreceptor drum 11 is to be irradiated with laser light.

The laser light corresponding to each color is emitted from a light source in the writing device 6 based on the image signal. The laser light is reflected by a polygon mirror and the reflected laser light is transmitted by a plurality of lenses. The laser light then passes through each optical path corresponding to yellow, cyan, magenta, and black components.

Laser light corresponding to yellow component is directed to a surface of the photoreceptor drum 11 in the leftmost process cartridge 10Y. More specifically, a polygon mirror, rotating at a high speed, scans the photoreceptor drum 11 with the laser light corresponding to yellow component in the direction of rotation axis, i.e., the main scanning direction. Thus, an electrostatic latent image corresponding to yellow component is formed on the photoreceptor drum 11 having been charged by the charger 12.

Similarly, laser light corresponding to cyan component is directed to a surface of the photoreceptor drum 11 in the second leftmost process cartridge 10C to form an electrostatic latent image corresponding to cyan component. Laser light corresponding to magenta component is directed to a surface of the photoreceptor drum 11 in the third leftmost process cartridge 10C to form an electrostatic latent image corresponding to magenta component. Laser light corresponding to black component is directed to a surface of the photoreceptor drum 11 in the fourth leftmost (i.e., the rightmost) process cartridge 10BK to form an electrostatic latent image corresponding to black component.

The surface of the photoreceptor drum 11 having the electrostatic latent image thereon then reaches a position where the photoreceptor drum 11 faces the developing device 13. The developing device 13 supplies toner to the electrostatic image to develop the electrostatic image into a toner image.

The surface of the photoreceptor drum 11 having the toner image thereon then reaches a position where the photoreceptor drum 11 faces the intermediate transfer belt 17. At that position, a primary transfer roller 14 is disposed in contact with an inner surface of the intermediate transfer belt 17. The toner images are sequentially transferred from each photoreceptor drum 11 onto the intermediate transfer belt 17 at each position where the primary transfer roller 14 is disposed, thus forming a composite toner image.

The surface of the photoreceptor drum 11 from which the toner image has been transferred then reaches a position where the photoreceptor drum 11 faces the cleaning device 15. The cleaning device 15 collects residual toner particles remaining on the photoreceptor drum 11.

The surface of the photoreceptor drum 11 having been cleaned then passes by the lubricant supply device 16 and a neutralizer. Thus, a series of imaging processes on the photoreceptor drum 11 is terminated.

A surface of the intermediate transfer belt 17 having the composite toner image thereon travels in a direction indicated by arrow in FIG. 1 and reaches a position where the intermediate transfer belt 17 faces the secondary transfer roller 18. The composite toner image is transferred from the intermediate transfer belt 17 onto the recording medium P at the position where the intermediate transfer belt 17 faces the secondary transfer roller 18. More specifically, when the secondary transfer roller 18 is supplied with a predetermined voltage (i.e., secondary transfer bias) from a power source, the composite toner image is transferred from the intermediate transfer belt 17 onto the recording medium P. In the present embodiment, the power source is configured to vary the secondary transfer bias.

The surface of the photoreceptor drum 17 then reaches a position where an intermediate transfer belt cleaning device faces the intermediate transfer belt 17. Residual toner particles remaining on the intermediate transfer belt 17 are collected by the intermediate transfer belt cleaning device. Thus, a series of transfer processes on the intermediate transfer belt 17 is terminated.

The recording medium P is fed from the paper feeder 7 to a position of the secondary transfer roller 18 via feed guides and a registration roller 19. More specifically, the recording medium P is fed by a paper feed roller 8 from the paper feeder 7 and passes through the feed guides to reach the registration roller 19. The recording medium P is then fed by the registration roller 19 to the position of the secondary transfer roller 18 in synchronization with an entry of the composite toner image formed on the intermediate transfer belt 17 to that position.

The recording medium P having the composite toner image thereon is fed to the fixing device 20. In the fixing device 20, the composite toner image is fixed on the recording medium P in between a fixing roller and a pressing roller.

The recording medium P having the fixed image thereon is discharged by a discharge roller 29 from the main body of the image forming apparatus 1 and is stacked on a discharge tray 5. Thus, a series of image forming processes is completed.

FIG. 2 is a magnified view of the process cartridge 10BK. Because of having the same configuration as the process cartridge 10BK, detailed descriptions of the process cartridges 10Y, 10C, and 10M are omitted.

The process cartridge 10BK integrally stores within a casing the photoreceptor drum 11 serving as an image bearing member, the charger 12 adapted to charge the photoreceptor drum 11, the developing device 13 adapted to develop an electrostatic latent image formed on the photoreceptor drum 11 into a toner image, the cleaning device 15 adapted to collect residual toner particles from the photoreceptor drum 11, and the lubricant supply device 16 adapted to supply lubricant to the photoreceptor drum 11.

The photoreceptor drum 11 is a negatively-chargeable organic photoreceptor in which a photosensitive layer is formed on a drum-shaped conductive support. More specifically, the photoreceptor drum 11 includes, from an innermost layer thereof, a conductive support (i.e., a base layer), an insulative undercoat layer, a photosensitive layer including a charge generation layer and a charge transport layer, and a protective layer (surface layer). In some embodiments, the conductive support is comprised of a conductive material having a volume resistivity of $10^{10}$ Ωcm or less.

The charger 12 is a roller member comprised of a conductive cored bar, the outer periphery of which is covered with a middle-resistivity elastic layer. The charger 12 is disposed downstream from the lubricant supply device 16 with respect to the direction of rotation of the photoreceptor drum 11. The charger 12 is disposed facing the photoreceptor drum 11 without contacting it so as not to be contaminated with the lubricant supplied to the photoreceptor drum 11 from the lubricant supply device 16.

Upon application of a predetermined voltage (i.e., charging bias) to the charger 12 from a power source, a surface of the photoreceptor drum 11 is uniformly charged. In the present embodiment, the power source is configured to vary the charging bias.

The developing device 13 includes a developing roller 13*a* facing the photoreceptor drum 11, a first conveyance screw 13*b*1 facing the developing roller 13*a*, a second conveyance screw 13*b*2 facing the first conveyance screw 13*b*1 with a divider therebetween, and a doctor blade 13*c* facing the developing roller 13*a*. The developing roller 13*a* is comprised of a magnet and a sleeve. The magnet is fixed inside the sleeve and forms magnetic poles on the peripheral surface of the sleeve. The sleeve is rotatable around the magnet. Owing to the action of the multiple magnetic poles formed on the sleeve by the magnet, the developing roller 13*a* can bear developer thereon.

The developing device 13 stores a two-component developer comprised of carrier particles and toner particles. In some embodiments, spherical toner particles having a circularity of 0.98 or more are used, which contributes to improvement of image quality. "Circularity" is defined as the average circularity of toner particles determined by a flow-type particle image analyzer FPIA-2000 from Sysmex Corporation by the procedure described below. First, add 0.1 to 0.5 ml of a surfactant (e.g., an alkylbenzene sulfonate) to 100 to 150 ml of water from which solid impurities have been removed. Further add 0.1 to 0.5 g of toner particles thereto. Subject the resulting suspension to a dispersion treatment by an ultrasonic disperser for about 1 to 3 minutes. Subject the suspension, containing 3,000 to 10,000 toner particles per microliter, to a measurement of shape distribution by the particle image analyzer.

Spherical toner particles can be prepared by, for example, heating irregular-shaped toner particles prepared by a pulverization process. Alternatively, spherical toner particles can be directly prepared by a polymerization process.

Generally, spherical toner particles are likely to pass through a gap between the photoreceptor drum 11 and a cleaning blade 15*a*, which is not preferable. In the present embodiment, the lubricant supply device 16 applies lubricant to the surface of the photoreceptor drum 11 so that the applied lubricant improves releasability (removability) of toner particles from the photoreceptor drum 11.

The cleaning device 15 is disposed upstream from the lubricant supply device 16 with respect to the direction of rotation of the photoreceptor drum 11. The cleaning device 15 includes a cleaning blade 15*a* disposed in contact with the photoreceptor drum 11 and a conveyance coil 15*b* adapted to convey toner particles which are collected by the cleaning device 15 to a waste toner tank. The cleaning blade 15*a* may be comprised of a rubber, such as urethane rubber. The cleaning blade 15*a* is in contact with the surface of the photoreceptor drum 11 at predetermined angle and pressure. The cleaning blade 15*a* is adapted to mechanically scrape off extraneous matters, such as untransferred toner particles, from the photoreceptor drum 11 and collect them in the cleaning device 15. The extraneous matters may further include, for example, paper powders generated from the recording medium P, discharge products generated by the charger 12, and additives released from toner particles.

The lubricant supply device 16 includes a solid lubricant 16*b*; a brush-like lubricant supply roller 16*a* slidably contactable with the solid lubricant 16*b*; a support member 16*c* supporting the solid lubricant 16*b*; a casing 16*f* storing the support member 16*c* and the solid lubricant 16*b*; a pressing mechanism including a rotatable member 16*g* and a tension spring 16*h*, adapted to bias the solid lubricant 16*b* in combination with the support member 16*c* against the lubricant supply roller 16*a*; and a blade member 16*d* adapted to form a thin layer of the lubricant on the photoreceptor drum 11. The blade member 16*d* is in contact with the photoreceptor drum 11 while facing the direction of rotation thereof at a downstream side from the lubricant supply roller 16*a* with respect to the direction of rotation of the photoreceptor drum 11. The lubricant supply device 16 is thus configured to form a thin layer of lubricant on the photoreceptor drum 11.

The image forming process is described in detail with reference to FIG. 2. The developing roller 13*a* rotates counterclockwise in FIG. 2. The developer is circulated within the developing device 13 in the longitudinal direction (i.e., the vertical direction to the paper plane) as the first conveyance screw 13*b*1 and the second conveyance screw 13*b*2 rotate, while being mixed with toner particles supplied from the toner container 28.

The toner particles are frictionally charged with the carrier particles and adsorbed to them. Thus, fresh developer is provided. The developer is carried on the developing roller 13*a*. The developer carried on the developing roller 13*a* reaches the position where the developing roller 13*a* faces the doctor blade 13*c*. After being regulated by the doctor blade 13*c*, the developer carried on the developing roller 13*a* further reaches the position where the developing roller 13*a* faces the photoreceptor drum 11, i.e., developing area.

In the developing area, toner particles in the developer are adhered to an electrostatic latent image formed on a surface of the photoreceptor drum 11. More specifically, an electrostatic latent image is developed into a toner image due to the electric field formed by the potential difference (i.e., developing potential) between the latent image potential (i.e., the potential of image portion having been irradiated with laser light L) and the developing bias supplied to the developing roller 13*a*.

Most of the toner particles adhered to the photoreceptor drum 11 are then transferred onto the intermediate transfer belt 17. Residual toner particles remaining on the photoreceptor drum 11 without being transferred are collected by the cleaning blade 15*a* in the cleaning device 15.

The image forming apparatus 1 further includes a toner supply part. The toner supply part includes the toner containers 28 each comprised of a replaceable bottle, and a toner hopper adapted to support and rotate the toner containers 28 and to supply fresh toner particles to the developing device 13. Each of the toner containers 28 is storing fresh toner particles of yellow, cyan, magenta, or black. On the inner peripheral surface of the toner container 28, a spiral projection is formed.

The toner container 28 can store transparent toner particles as well as toner particles of yellow, cyan, magenta, or black. In some embodiments, the image forming apparatus includes the fifth toner container 28 storing transparent toner particles that improve gloss of the resulting image.

Fresh toner particles stored in the toner container 28 are supplied to the developing device 13 through a toner supply opening as toner particles existing in the developing device 13 are consumed. Consumption of the existing toner particles is directly or indirectly detected by a reflective photosensor disposed facing the photoreceptor drum 11 and a magnetic sensor disposed below the second conveyance screw 13*b*2.

The lubricant supply device 16 is described in detail below. As described above, referring to FIG. 2, the lubricant supply device 16 includes a solid lubricant 16*b*; a brush-like lubricant supply roller 16*a* slidably contactable with the solid lubricant 16*b*; a support member 16*c* supporting the solid lubricant 16*b*; a casing 16*f* storing the support member 16*c* and the solid lubricant 16*b*; a pressing mechanism including a rotatable member 16*g* and a tension spring 16*h*, adapted to bias the solid lubricant 16*b* in combination with the support member 16*c* against the lubricant supply roller 16*a*; and a blade member 16*d* adapted to form a thin layer of the lubricant on the photoreceptor drum 11.

The casing 16*f* is a box-like member storing the support member 16*c* and the solid lubricant 16*b* without preventing the solid lubricant 16*b* from moving toward and pressing against the lubricant supply roller 16*a*. The casing 16*f* is supported by the lubricant supply device 16. The gap between the casing 16*f* and the solid lubricant 16*b* or support member 16*c* is set relatively small to the extent that the casing 16*f* does not prevent the solid lubricant 16*b* from pressing against the lubricant supply roller 16*a*. Such a small gap can prevent the solid lubricant 16*b* from leaning on the lubricant supply roller 16*a*.

The casing 16*f* is movable in the reverse direction to the pressing direction of the solid lubricant 16*b* against the lubricant supply roller 16*a*. The casing 16*f* is connected to a movable device 46, such as a linkage mechanism. The movable device 46 is adapted to vary the pressing force of the solid lubricant 16*b* against the lubricant supply roller 16*a* by moving the casing 16*f* in the reverse direction to the pressing direction, thereby varying lubricant supply to the photoreceptor drum 11.

The lubricant supply roller 16*a* is comprised of a cored bar and a base fabric on which brush strings having a length of 0.2 to 20 mm (0.5 to 10 mm in some embodiments) are implanted. The base fabric is spirally wound around the cored bar.

When the lengths of the brush strings are greater than 20 mm, the brush strings are likely to slant in a predetermined direction as are repeatedly brought into slidable contact with the photoreceptor drum 11. As a result, lubricant scraping performance (from the solid lubricant 16*b*) and toner removing performance (from the photoreceptor drum 11) of the brush strings may deteriorate. When the lengths of the brush strings are less than 0.2 mm, physical contacting force of the brush strings with the solid lubricant 16*b* or photoreceptor drum 11 is too weak.

The lubricant supply roller 16*a* is driven to rotate clockwise in FIG. 2 by a driving motor 45 so as to face the direction of rotation of the photoreceptor drum 11 rotating clockwise. The lubricant supply roller 16*a* is in slidable contact with both the solid lubricant 16*b* and the photoreceptor drum 11. The lubricant supply roller 16*a* scrapes the solid lubricant 16*b* off, conveys it to the position where the solid lubricant 16*b* is in slidable contact with the photoreceptor drum 11, and applies (supplies) it to the photoreceptor drum 11.

The driving motor 45 may be a speed variable motor configured to vary the revolution of the lubricant supply roller 16*a* so as to vary lubricant supply to the photoreceptor drum 11.

The pressing mechanism biases the solid lubricant 16*b*, supported by the support member 16*c*, against the lubricant supply roller 16*a* so that the lubricant supply roller 16*a* is prevented from unevenly contact the solid lubricant 16*b*. The pressing mechanism is comprised of the support member 16*c*, pair of rotatable members 16*g* rotatably supported by the support member 16*c*, tension spring 16*h* connected to the pair of rotatable members 16*g*, and bearings 16*j*.

The solid lubricant 16*b* comprises boron nitride and a metal salt of fatty acid. The solid lubricant 16*b* is unlikely to deteriorate even after being exposed to electric discharge through the charging and transfer processes because boron nitride does not change its characteristics by the electric discharge. The solid lubricant 16*b* comprising boron nitride prevents the photoreceptor drum 11 from being oxidized or vaporizing by the electric discharge.

On the other hand, a lubricant consisting of boron nitride only may not be uniformly applied to the surface of the photoreceptor drum 11. For this reason, in accordance with an embodiment, the solid lubricant 16*b* includes a metal salt of fatty acid in combination with boron nitride. The solid lubricant 16*b* can be effectively and uniformly applied to the surface of the photoreceptor drum 11, thus keeping providing high lubricity to the photoreceptor drum 11 for an extended period of time. Specific examples of usable metal salts of fatty acids include, but are not limited to, those having a lamella crystal structure, such as zinc stearate, calcium stearate, barium stearate, aluminum stearate, and magnesium stearate; and lauroyl lysine, zinc sodium monocetyl phosphate, and lauroyl taurine calcium. When zinc stearate is employed as the metal salt of fatty acid, the solid lubricant 16*b* has an improved extensibility on the photoreceptor drum 11 as well as a lower hygroscopicity which provides constant lubricity regardless of humidity.

The solid lubricant 16*b* may further include additives such as a fluorine-based resin, and liquid or gaseous materials such as silicone oil, fluorine-based oil, and natural wax.

The solid lubricant 16*b* may be obtained by pouring powder lubricant into a mold and forming it into a solid bar by application of pressure, or alternatively, pouring heat-melted powder lubricant into a mold and cooling it into a solid block. When raw-material lubricant is formed into a solid bar or block, a binder may be optionally mixed therewith.

After the lubricant supply roller 16*a* scrapes the solid lubricant 16*b* off and applies the powdered lubricant to the surface of the photoreceptor drum 11, the blade member 16*d* evens out the powdered lubricant. The blade member 16*d* forms the powdered lubricant into a uniform thin layer on the surface of the photoreceptor drum 11 so that the lubricant can satisfactorily express its lubricity. The finer the powdered lubricant applied by the lubricant supply roller 16*a*, the thinner the lubricant layer formed on the photoreceptor drum 11 by the blade member 16*d*.

Figure 3:
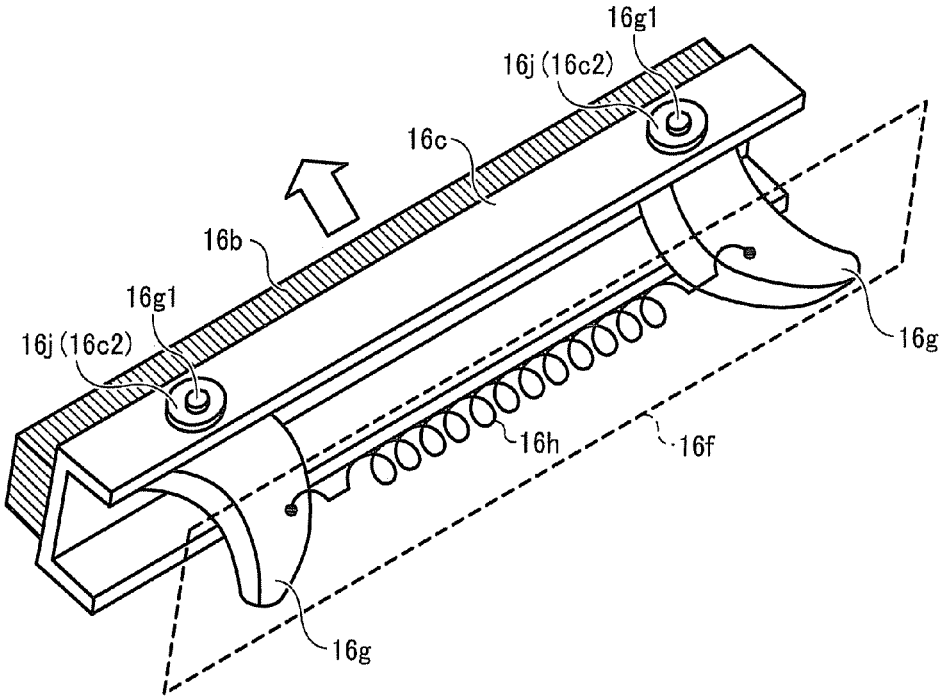
FIG. 3 is a perspective view of a lubricant unit in a lubricant supply device according to an embodiment.

FIG. 3 is a perspective view of a lubricant unit in the lubricant supply device 16. The lubricant unit is comprised of the pressing mechanism including the support member 16*c*, pair of rotatable members 16*g*, tension spring 16*h*, and bearings 16*j*; and the solid lubricant 16*b*. The lubricant unit is detachably attachable to the lubricant supply device 16 (or the process cartridge 10BK). Thus, the lubricant unit is easily replaceable.

Referring to FIG. 3, the solid lubricant 16*b* is adhesively supported by the support member 16*c*. More specifically, the solid lubricant 16*b* is adhered to the support member 16*c* by double-faced adhesive tape or adhesive agent. The support member 16*c* is comprised of a plate bended into a shape as illustrated in FIG. 3. The support member 16*c* has multiple holes 16*c*2 for supporting the rotatable members 16*g* through the bearings 16*j* on its both surfaces.

The support member 16*c* rotatably supports a pair of rotatable members 16*g* disposed apart from each other in the axial direction (i.e., the vertical direction to the paper plane). The rotatable members 16*g* are each rotated in a predetermined direction due to biasing force from the tension spring 16*h*. Thus, the rotatable members 16*g* indirectly press the solid lubricant 16*b* against the lubricant supply roller 16*a* via the support member 16*c*.

A shaft 16*g*1 is disposed on both sides of each of the rotatable members 16*g*. The shaft 16*g*1 is engaged with the hole 16*c*2 while fitting the bearing 16*j* by insertion so that the rotatable members 16*g* are rotatably supported by the support member 16*c*. The rotatable members 16*g* are symmetrically disposed with respect to the width direction of the support member 16*c*.

The rotatable members 16*g* are connected by the tension spring 16*h*. More specifically, hook parts on both ends of the tension spring 16*h* are each connected to a hole disposed on each of the rotatable members 16*g*.

The tension spring 16*h* rotates the rotatable members 16*g* in opposite directions while pressing the rotatable members 16*g* against the casing 16*f*, thus biasing the support member 16*c* toward the lubricant supply roller 16*a*. More specifically, the rotatable members 16*g* receive biasing force from the tension spring 16*h* so that cam members, disposed in contact with inner wall surfaces of the casing 16*f*, approach each other. Thus, the rotatable member 16*g* on the left side in FIG. 3 is biased so as to rotate counterclockwise around the shaft 16*g*1. By contrast, the rotatable member 16*g* on the right side in FIG. 3 is biased so as to rotate clockwise around the shaft 16*g*1.

Referring back to FIG. 2, the driving motor 45, adapted to rotate the lubricant supply roller 16*a*, functions as a varying device for varying the amount of lubricant supplied from the lubricant supply roller 16*a* to the photoreceptor drum 11 (hereinafter "lubricant supply"). When increasing the lubricant supply, a controller 48 controls the lubricant supply roller 16*a* to increase its revolution. When decreasing the lubricant supply, the controller 48 controls the lubricant supply roller 16*a* to decrease its revolution. This is because the revolution of the lubricant supply roller 16*a* is approximately proportional to the amount of lubricant scraped by the lubricant supply roller 16*a* from the solid lubricant 16*b*.

According to a first embodiment illustrated in FIG. 2, a detector 41 is disposed adjacent to the lubricant supply device 16 (solid lubricant 16*b*). The detector 41 is adapted to detect absolute humidity (i.e., amount of moisture) around the solid lubricant 16*b*. The detector 41 includes a temperature sensor 42 adapted to detect temperature around the solid lubricant 16*b* and a relative humidity sensor 43 adapted to detect relative humidity around the solid lubricant 16*b*. The detector 41 transmits temperature and humidity data detected by the temperature sensor 42 and the relative humidity sensor 43 to the controller 48. Absolute humidity (i.e., amount of moisture) is determined based on a conversion table stored in a memory of the controller 48. The temperature sensor 42 and the relative humidity sensor 43 may be integrally combined to form a temperature-humidity sensor.

Figure 4:
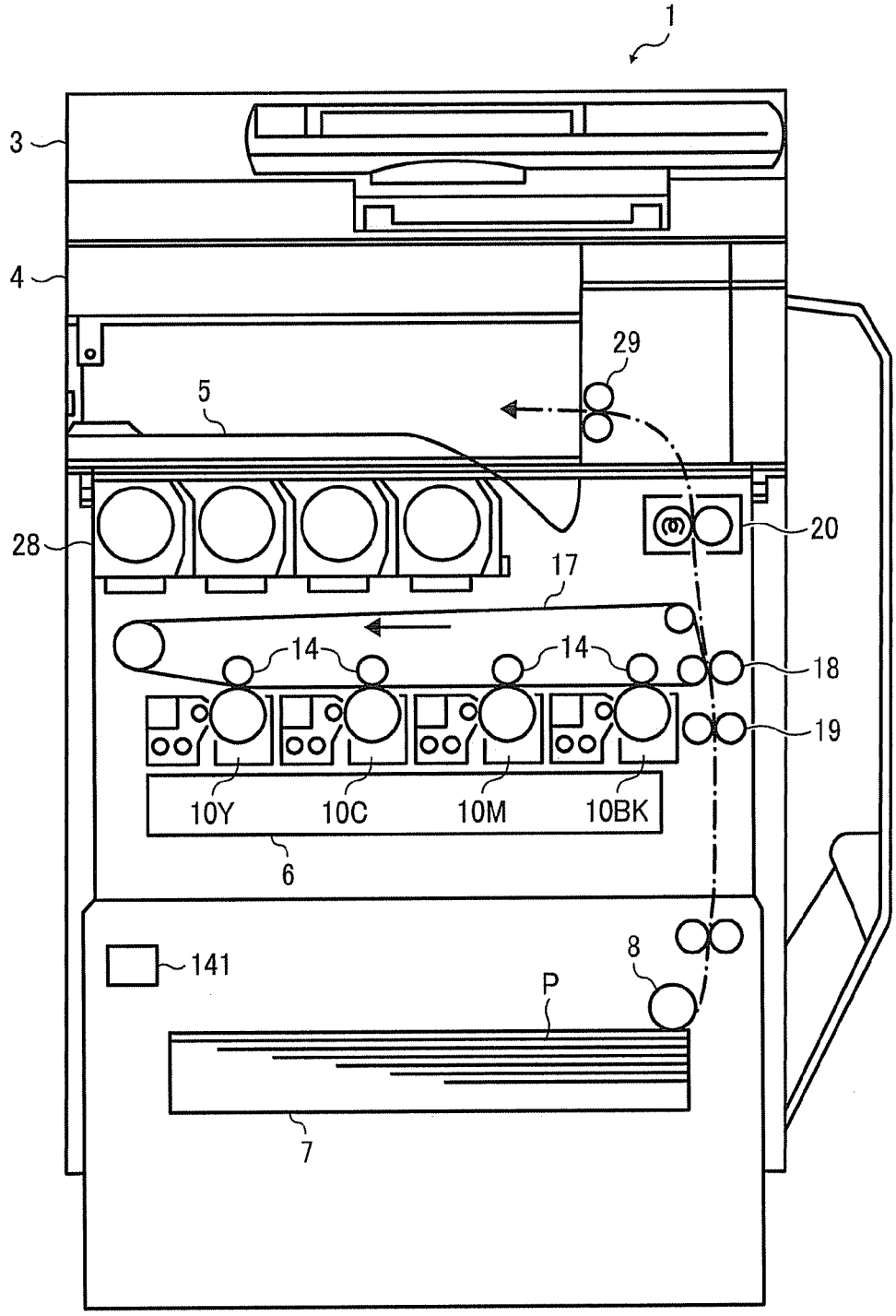
FIG. 4 is a schematic view of an image forming apparatus according to an embodiment.
Figures 5, 6:
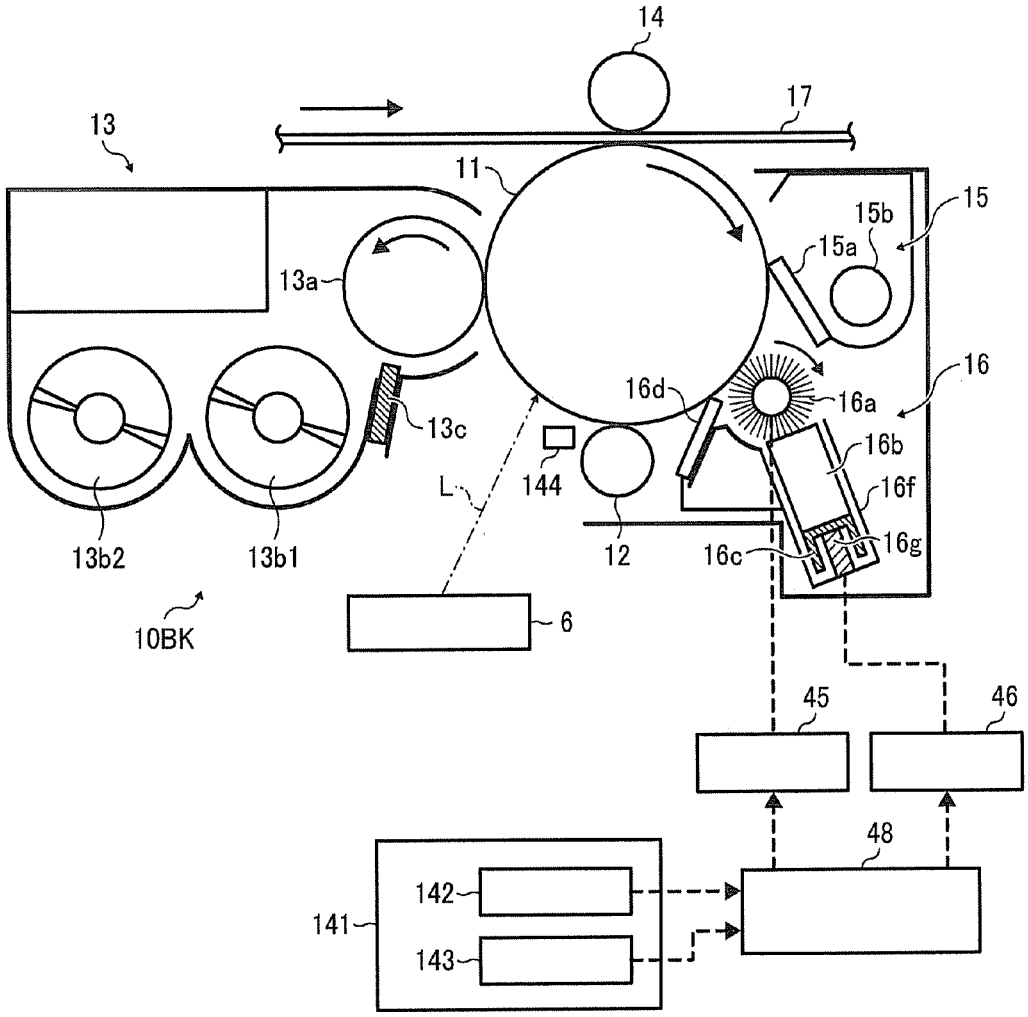
FIG. 5 is a magnified view of the process cartridge included in the image forming apparatus illustrated in FIG. 4.
FIG. 6 is a table showing controlling conditions of the revolution of a lubricant supply roller in a lubricant supply device according to an embodiment accompanied by absolute humidity change.

According to a second embodiment illustrated in FIGS. 4 and 5, a first detector 141 is disposed apart from the process cartridges 10Y, 10C, 10M, and 10BK. Specifically, the first detector 141 is disposed adjacent to the paper feeder 7 or a waste toner tank within the image forming apparatus 1. The first detector 141 is adapted to detect temperature and humidity outside (around) the image forming apparatus 1. The amount of lubricant supplied from the lubricant supply device 16 is controlled based on the absolute humidity detected by the first detector 141.

The first detector 141 may be disposed inside the image forming apparatus to indirectly detect outside temperature and humidity. Alternatively, the first detector 141 may be exposed to the outside of the image forming apparatus 1 to directly detect outside temperature and humidity.

In the second embodiment, a second detector 144 is further disposed facing the photoreceptor drum 11 at a downstream side from the charger 12 with respect to the direction of rotation of the photoreceptor drum 11, as illustrated in FIG. 4. The second detector 144 is adapted to detect temperature and humidity around the photoreceptor drum 11. The second detector 144 may be comprised of a temperature and humidity sensor, for example.

As described above, in the second embodiment, the first detector 141 is disposed apart from the photoreceptor drum 11 and the lubricant supply device 16. The first detector 141 is adapted to detect temperature and humidity equivalent to those around the image forming apparatus 1.

Referring to FIG. 5, the first detector 141 is adapted to detect absolute humidity (i.e., amount of moisture) around the image forming apparatus 1. The first detector 141 includes a temperature sensor 142 adapted to detect temperature equivalent to that around the image forming apparatus 1 and a relative humidity sensor 143 adapted to detect relative humidity equivalent to that around the image forming apparatus 1. The first detector 141 transmits temperature and humidity data detected by the temperature sensor 142 and the relative humidity sensor 143 to the controller 48. Absolute humidity (i.e., amount of moisture) is determined based on a conversion table stored in a memory of the controller 48. The temperature sensor 142 and the relative humidity sensor 143 may be integrally combined to form a temperature-humidity sensor.

The first detector 141 is located on a position which is less sensitive to heat generated from peripheral movable members and is more reflective of environmental conditions outside the image forming apparatus 1 (e.g., a position having an enough space for releasing heat without peripheral heat-generating movable members) regardless of operational status of the image forming apparatus 1. Accordingly, a position adjacent to the photoreceptor drum 11 (i.e., the position of the second detector 144) is not suitable for the first detector 141 because the temperature rapidly increases upon occurrence of continuous printing or rapidly decreases upon termination of operation regardless of external environment conditions.

In both of the first and second embodiments, the driving motor 45 is controlled so that the amount of lubricant supplied to the photoreceptor drum 11 is varied based on temperature and humidity (i.e., absolute humidity) detected by the detector 41 or the first detector 141. More specifically, when the detector 41 or the first detector 141 detects a high-level absolute humidity, the driving motor 45 is controlled so that the lubricant supply is increased. By contrast, when the detector 41 or the first detector 141 detects a low-level absolute humidity, the driving motor 45 is controlled so that the lubricant supply is decreased.

For example, referring to FIG. 6, when a middle-level absolute humidity (e.g., 10 to 15 g/cm$^3$) is detected, the controller 48 controls the lubricant supply roller 16*a* to have a revolution of a standard value $\alpha$ (e.g., 200 rpm). When a low-level absolute humidity (e.g., 10 g/cm$^3$ or less) is detected, the controller 48 controls the lubricant supply roller 16*a* to have a revolution less than the standard value $\alpha$ (e.g., $0.8\times\alpha$). When a high-level absolute humidity (e.g., 15 g/cm$^3$ or more) is detected, the controller 48 controls the lubricant supply roller 16*a* to have a revolution greater than the standard value $\alpha$ (e.g., $1.2\times\alpha$).

Figure 7A:
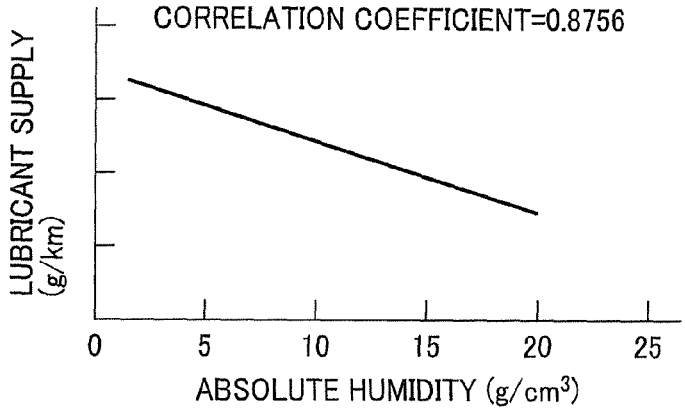
FIGS. 7A to 7C are graphs showing relations between various environmental conditions and lubricant supply in the lubricant supply device.
Figure 7B:
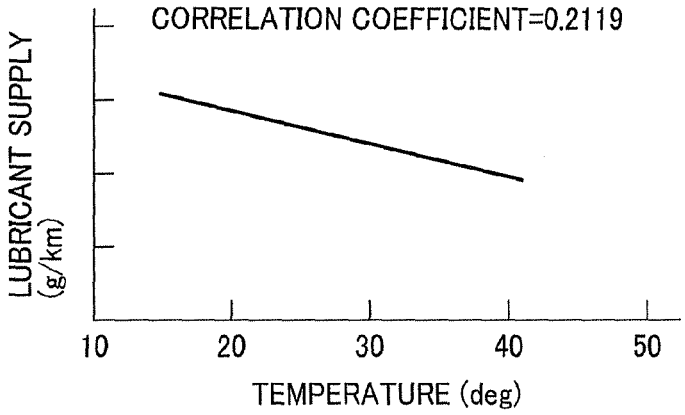
Figure 7C:
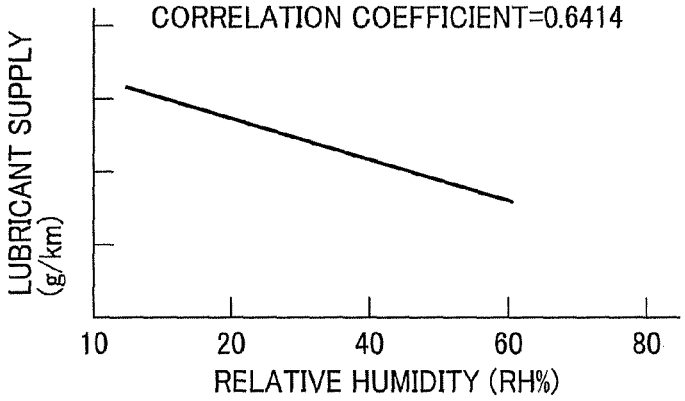

The lubricant supply is more highly correlated with absolute humidity rather than temperature or relative humidity. FIGS. 7A to 7C are graphs showing relations between various environmental conditions and the lubricant supply in the lubricant supply device 16 according to embodiments. FIG. 7A is a graph showing a relation between absolute humidity and the lubricant supply. FIG. 7B is a graph showing a relation between temperature and the lubricant supply. FIG. 7C is a graph showing a relation between relative humidity and the lubricant supply.

The correlation coefficient of the linear function shown in FIG. 7A (i.e., a relation between absolute humidity and the lubricant supply) is 0.8756, which is closest to 1 among the correlation coefficients shown in FIGS. 7A to 7C. This indicates that the lubricant supply is most highly correlated with absolute humidity.

One reason why the lubricant supply is more highly correlated with absolute humidity than relative humidity is considered to be that how much the lubricant supply roller 16*a* scrapes off the solid lubricant 16*b* greatly depends on moisture content of the lubricant. Because the moisture content of the lubricant depends on absolute humidity (i.e., the moisture content in the air) rather than relative humidity, the lubricant supply is more highly correlated with absolute humidity than relative humidity. Additionally, flexibility of the brush strings of the lubricant supply roller 16*a* is influenced by the moisture content. As the moisture content (i.e., absolute humidity) increases, flexibility of the brush strings decreases and therefore the lubricant supply decreases. As the moisture content (i.e., absolute humidity) decreases, flexibility of the brush strings increases and therefore the lubricant supply increases. Thus, lubricant supply is highly correlated with absolute humidity.

In the second embodiment, the absolute humidity as a characteristic value for controlling the lubricant supply is detected by the first detector 141 disposed apart from the photoreceptor drum 11, not by the second detector 144 disposed adjacent to the photoreceptor drum 11. The lubricant supply is varied based on absolute humidity detected by the first detector 141 which is equivalent to absolute humidity outside the image forming apparatus 1. Absolute humidity detected by the first detector 141 is less influenced by operational status of the image forming apparatus 1 and more highly correlated with moisture content of the solid lubricant 16*b* compared to that detected by the second detector 144.

Figure 8A:
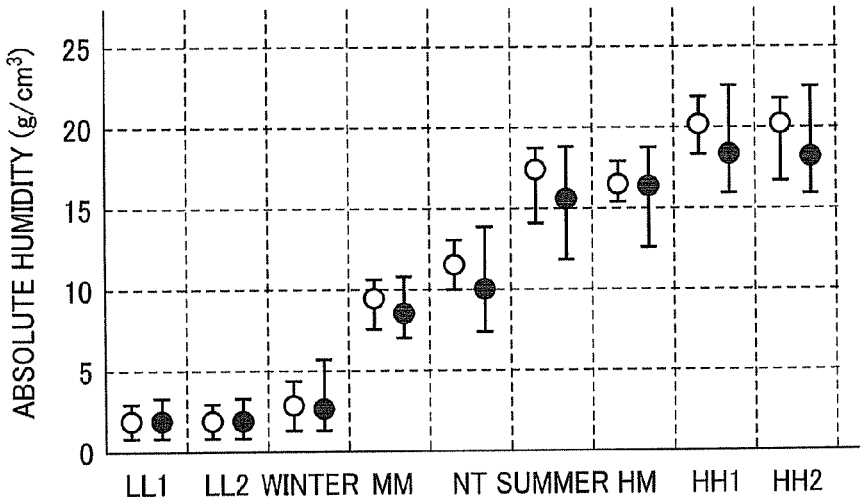
FIGS. 8A and 8B are graphs showing fluctuation ranges of absolute humidity (i.e., moisture content) detected by a first detector and a second detector in the lubricant supply device.

FIG. 8A is a graph showing fluctuation ranges of absolute humidity (i.e., moisture content) detected by the first detector 141 (shown by white dots) and the second detector 144 (shown by black dots). Each length of vertical line segment represents a fluctuation range and each white or black dot represents the center value in each fluctuation range.

Figure 8B:
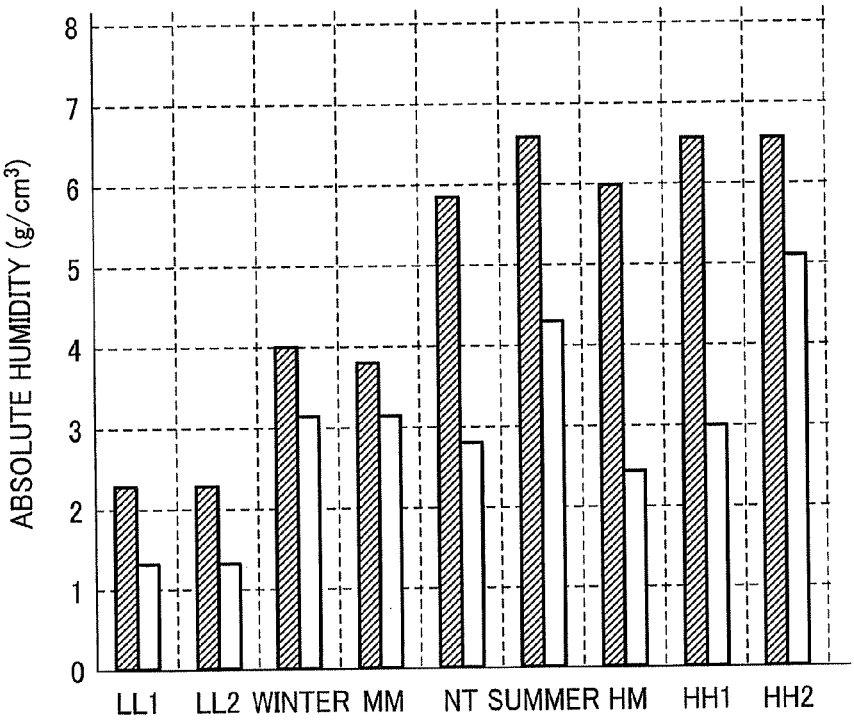

FIG. 8B is a bar graph showing the fluctuation ranges of absolute humidity (i.e., moisture content) shown in FIG. 8A, detected by the first detector 141 (shown by white bars) and the second detector 144 (shown by shaded bars).

With respect to legends on the lateral axis in FIGS. 8A and 8B, "LL1" and "LL2" represent predetermined low-temperature and low-humidity conditions, "WINTER" represents a winter-simulated condition, "MM" represents a predetermined normal-temperature and normal-humidity condition, "SUMMER" represents a summer-simulated condition, "HM" represents a predetermined high-temperature and normal-humidity condition, and "HH1" and "HH2" represent predetermined high-temperature and high-humidity conditions.

Within the image forming apparatus 1, the air is circulated by generating airflow by a fan, etc., so as not to accumulate heat generated from driving photoreceptor drum 11 or a heat source in the fixing device 20. Due to the air circulation, absolute humidity inside the image forming apparatus 1 is approximately equal to that outside the image forming apparatus 1. However, as shown in FIGS. 8A and 8B, absolute humidity detected by the first detector 141 is higher than those detected by the second detector 144 in whole in terms of its absolute value. The reason is explained referring to the following equation.

Absolute Humidity=Moisture Content in the Air/
Amount of Saturated Vapor

Due to the air circulation, the first and second detectors 141 and 144 detect substantially the same moisture content in the air. On the other hand, the amount of saturated vapor increases as the temperature increases. Therefore, at the position of the second detector 144 at which the degree of temperature increase, caused upon operation of the image forming apparatus 1, is greater than the outside, absolute humidity becomes relatively small.

Additionally, as shown in FIGS. 8A and 8B, fluctuation ranges of absolute humidity detected by the first detector 141 are smaller than those detected by the second detector 144 in whole. The reason is considered to be that the amount of saturated vapor increases as the temperature increases, as described above. In particular, at the position of the second detector 144 at which the degree of temperature increase is relatively large, the degree of increase of the amount of saturated vapor upon the temperature increase is also relatively large. Therefore, fluctuation range of absolute humidity also becomes relatively large. By contrast, at the position of the first detector 141 at which the degree of temperature increase is relatively small, the degree of increase of the amount of saturated vapor upon the temperature increase is also relatively small. Therefore, fluctuation range of absolute humidity also becomes relatively small. Additionally, it is considered that at the position of the second detector 144, temperature and humidity are more likely to fluctuate due to the circulation of the air.

Thus, absolute humidity detected by the first detector 141 is less influenced by external conditions and more highly correlated with moisture content of the solid lubricant 16*b* compared to that detected by the second detector 144. For this reason, in the second embodiment, the lubricant supply is controlled based on detection results of the first detector 141.

By controlling the driving motor 45 based on absolute humidity around the lubricant supply device 16 detected by the detector 41 (in the first embodiment) or absolute humidity equivalent to that around the image forming apparatus 1 detected by the first detector 141 (in the second embodiment), the lubricant supply does not fall below the lower limit supply regardless of absolute humidity variation, as shown by solid line in FIG. 9. Accordingly, troubles which may be caused by a shortage of the lubricant supply, such as deterioration of cleaning blade, defective cleaning, and formation of toner film, are suppressed regardless of environmental variation. Additionally, troubles which may be caused by an excess of the lubricant supply, such as shorter lifespan of the solid lubricant 16*b*, are suppressed even when absolute humidity is low.

In the above embodiments, the varying device for varying the lubricant supply is adapted to vary the revolution of the lubricant supply roller 16*a*. In some embodiments, the varying device is adapted to vary the pressing force of the solid lubricant 16*b* against the lubricant supply roller 16*a*. In further embodiments, the varying device is adapted to vary both the revolution and the pressing force.

For example, referring to FIG. 2 and FIG. 5, when the detector 41 or the first detector 141 detects a high-level absolute humidity, the varying device 46 is controlled so that the pressing force of the solid lubricant 16*b* against the lubricant supply roller 16*a* is increased. By contrast, when the detector 41 or the first detector 141 detects a low-level absolute humidity, the varying device 46 is controlled so that the pressing force of the solid lubricant 16*b* against the lubricant supply roller 16*a* is decreased. This is because the pressing force of the solid lubricant 16*b* against the lubricant supply roller 16*a* is approximately proportional to the amount of lubricant scraped by the lubricant supply roller 16*a* from the solid lubricant 16*b*.

It is possible that the driving motor 45 is controlled so as to increase the lubricant supply only when absolute humidity detected by the detector 41 or the first detector 141 is higher than a predetermined value.

For example, referring to FIG. 10, when a low-level or middle-level absolute humidity, which is smaller than a predetermined value, is detected, the controller 48 controls the lubricant supply roller 16*a* to have a revolution of a standard value $\alpha$. When a high-level absolute humidity (e.g., greater than a predetermined value) is detected, the controller 48 controls the lubricant supply roller 16*a* to have a revolution greater than the standard value $\alpha$ (e.g., $1.2\times\alpha$).

In these cases, the lubricant supply does not fall below the lower limit even when absolute humidity becomes high as shown by solid line in FIG. 11. Accordingly, troubles which may be caused by a shortage of the lubricant supply, such as deterioration of cleaning blade, defective cleaning, and formation of toner film, are suppressed regardless of environmental variation.

Referring to FIG. 10, the lubricant supply is always greater than the lower limit supply regardless of absolute humidity variation. Therefore, the photoreceptor drum 11 is not likely to deteriorate even when being exposed to charging hazard.

In the second embodiment, a voltage to be applied to the secondary transfer roller 18 (i.e., secondary transfer bias) is controlled based on a result detected by the first detector 141. For example, when absolute humidity (i.e., moisture content) detected by the first detector 141 is relatively high, the secondary transfer bias is more increased compared to a case in which the absolute humidity (i.e., moisture content) detected by the first detector 141 is relatively low. This is because that a current is more flowable and charge is less retentive in the surface of the recording medium P when the moisture content of the recording medium P becomes larger as absolute humidity becomes larger. The moisture content of the recording medium P is more highly correlated with absolute humidity detected by the first detector 141 than that detected by the second detector 144. Therefore, the transfer process is controlled based on a result detected by the first detector 141.

By contrast, a voltage to be applied to the charger 12 (i.e., charging bias) is controlled based on a result detected by the second detector 144. For example, when absolute humidity (i.e., moisture content) detected by the second detector 144 is relatively high, the charging bias is more increased compared to a case in which the absolute humidity (i.e., moisture content) detected by the second detector 144 is relatively low. This is because that a current is more flowable and charge is less retentive in the surfaces of the photoreceptor drum 11 and the charger 12 when the moisture content of the recording medium P becomes larger as absolute humidity becomes larger. The moisture content of the photoreceptor drum 11 or the charger 12 is more highly correlated with absolute humidity detected by the second detector 144 than that detected by the first detector 141. Therefore, the charging process is controlled based on a result detected by the second detector 144.

In accordance with some embodiments, the lubricant supply is controlled based on absolute humidity around the solid lubricant 16*b* (in the first embodiment) or around the image forming apparatus 1 (in the second embodiment), both of which are highly correlated with the lubricant supply. Therefore, a sufficient amount of lubricant is reliably and constantly supplied to the photoreceptor drum 11 regardless of environmental variation.

In one or more embodiments, the photoreceptor drum 11, charger 12, developing device 13, cleaning device 15, and lubricant supply device 16 are integrated into each of the process cartridges 10Y, 10C, 10M, and 10BK, which is more compact and easy to maintain. Alternatively, in some embodiments, each of the photoreceptor drum 11, charger 12, developing device 13, cleaning device 15, and lubricant supply device 16 is independently and detachably mounted on the image forming apparatus 1.

According to some embodiments, the developing device 13 employs either a two-component developing method or a one-component developing method.

The above-described image forming apparatus 1 according to an embodiment is a tandem-type full-color image forming apparatus having the intermediate transfer belt 17. Alternatively, according to some embodiments, a tandem-type full-color image forming apparatus having a transfer conveyance belt (in which toner images formed on respective multiple photoreceptor drums arranged facing the transfer conveyance belt are transferred onto a recording medium conveyed by the transfer conveyance belt) and a monochrome image forming apparatus are also provided.

The above-described lubricant supply device 16 is for supplying lubricant to the photoreceptor drum 11. According to some embodiments, a lubricant supply device for supplying lubricant to a member other than the photoreceptor drum 11, such as the intermediate transfer belt 17, is also provided. In such a lubricant supply device according to an embodiment, the lubricant supply is controlled based on absolute humidity around the lubricant supply device or absolute humidity equivalent to those outside the image forming apparatus 1, in a similar manner to the lubricant supply device 16.

In some embodiments, the lubricant supply roller 16*a* is an elastic sponge-like roller. In such a lubricant supply device according to an embodiment, the lubricant supply is controlled based on absolute humidity around the lubricant supply device or absolute humidity equivalent to those outside the image forming apparatus 1, in a similar manner to the lubricant supply device 16.

Additional modifications and variations in accordance with further embodiments of the present invention are possible in light of the above teachings. It is therefore to be understood that within the scope of the appended claims the invention may be practiced other than as specifically described herein.

What is claimed is:

1. A lubricant supply device, comprising:
- a solid lubricant;
- a lubricant supply roller adapted to supply the lubricant to a toner image bearing member, the lubricant supply roller being rotatable in a predetermined direction while slidably contacting both the solid lubricant and the toner image bearing member;
- a detector adapted to detect an absolute humidity around the lubricant supply device; and
- a varying device adapted to vary an amount of the lubricant to be supplied to the toner image bearing member based on the absolute humidity detected by the detector.

2. The lubricant supply device according to claim 1, wherein the varying device is adapted to increase the amount of the lubricant to be supplied to the toner image bearing member when the absolute humidity is relatively high and to decrease the amount of the lubricant to be supplied to the toner image bearing member when the absolute humidity is relatively low.

3. The lubricant supply device according to claim 1, wherein the varying device is adapted to increase the amount of the lubricant to be supplied to the toner image bearing member only when the absolute humidity is higher than a predetermined value.

4. The lubricant supply device according to claim 1, wherein the varying device is adapted to vary at least one of a revolution of the lubricant supply roller or a pressing force of the solid lubricant against the lubricant supply roller.

5. A process cartridge, comprising:
- a toner image bearing member; and
- a lubricant supply device, including:
  - a solid lubricant;
  - a lubricant supply roller adapted to supply the lubricant to the toner image bearing member, the lubricant supply roller being rotatable in a predetermined direction while slidably contacting both the solid lubricant and the toner image bearing member;
  - a detector adapted to detect an absolute humidity around the lubricant supply device; and
  - a varying device adapted to vary an amount of the lubricant to be supplied to the toner image beating member based on the absolute humidity detected by the detector.

6. The process cartridge according to claim 5, further comprising a cleaner adapted to clean the toner image bearing member, the cleaner being disposed upstream from the lubricant supply device with respect to a direction of rotation of the toner image bearing member.

7. An image forming apparatus, comprising:
- a toner image bearing member;
- a lubricant supply device, including:
  - a solid lubricant;
  - a lubricant supply roller adapted to supply the lubricant to the toner image bearing member, the lubricant supply roller being rotatable in a predetermined direction while slidably contacting both the solid lubricant and the toner image bearing member;
  - a detector adapted to detect an absolute humidity around the lubricant supply device; and
  - a varying device adapted to vary an amount of the lubricant to be supplied to the toner image beating member based on the absolute humidity detected by the detector,
- a charger adapted to charge the toner image bearing member;
- an irradiator adapted to irradiate the charged toner image bearing member with light to form an electrostatic latent image thereon;
- a developing device adapted to develop the electrostatic latent image into a toner image; and
- a transfer device adapted to transfer the toner image from the toner image bearing member onto a recording medium.

8. An image forming apparatus, comprising:
- a toner image bearing member;
- a lubricant supply device, including:
  - a solid lubricant;
  - a lubricant supply roller adapted to supply the lubricant to the toner image bearing member, the lubricant supply roller being rotatable in a predetermined direction while slidably contacting both the solid lubricant and the toner image bearing member;

a first detector adapted to detect an absolute humidity around the image forming apparatus, the first detector being disposed apart from the toner image bearing member; and a varying device adapted to vary an amount of the lubricant to be supplied to the toner image bearing member based on the absolute humidity detected by the first detector;

a charger adapted to charge the toner image bearing member;

an irradiator adapted to irradiate the charged toner image bearing member with light to form an electrostatic latent image thereon;

a developing device adapted to develop the electrostatic latent image into a toner image; and a transfer device adapted to transfer the toner image from the toner image bearing member onto a recording medium.

9. The image forming apparatus according to claim 8, wherein the varying device is adapted to increase the amount of the lubricant to be supplied to the toner image bearing member when the absolute humidity is relatively high and to decrease the amount of the lubricant to be supplied to the toner image bearing member when the absolute humidity is relatively low.

10. The image forming apparatus according to claim 8, wherein the varying device is adapted to increase the amount of the lubricant to be supplied to the toner image bearing member only when the absolute humidity is higher than a predetermined value.

11. The image forming apparatus according to claim 8, wherein the varying device is adapted to vary at least one of a revolution of the lubricant supply roller or a pressing force of the solid lubricant against the lubricant supply roller.

12. The image forming apparatus according to claim 8, further comprising a cleaner adapted to clean the toner image bearing member, the cleaner being disposed upstream from the lubricant supply device with respect to a direction of rotation of the toner image bearing member.

13. The image forming apparatus according to claim 8, further comprising a second detector adapted to detect an absolute humidity around the toner image bearing member, wherein a voltage to be supplied to the charger is controlled based on the absolute humidity detected by the second detector, and wherein a voltage to be applied to the transfer device is controlled based on the absolute humidity detected by the first detector.

* * * * *